United States Patent [19]

Morgan

[11] 4,418,478

[45] Dec. 6, 1983

[54] DRAPERY PLEAT AND FOLD LINE MARKING MACHINE

[76] Inventor: Ronald W. Morgan, 6311 Lime Rd., Louisville, Ky. 40222

[21] Appl. No.: 268,911

[22] Filed: Jun. 1, 1981

[51] Int. Cl.[3] ..... B43L 9/08

[52] U.S. Cl. ..... 33/192

[58] Field of Search ..... 33/189, 191, 192

[56] References Cited

U.S. PATENT DOCUMENTS

| | | | |
|---|---|---|---|
| 2,853,793 | 9/1958 | Ripp et al. | 33/192 |
| 2,998,659 | 9/1961 | Yaworsky | 33/192 |
| 3,145,480 | 8/1964 | Caracoes | 33/192 |
| 3,696,515 | 10/1972 | Tuskos | 33/192 |

FOREIGN PATENT DOCUMENTS

| | | | |
|---|---|---|---|
| 21310 | of 1915 | United Kingdom | 33/192 |

*Primary Examiner*—Richard R. Stearns
*Attorney, Agent, or Firm*—Wm. R. Price

[57] ABSTRACT

A machine is shown for marking the spaces for forming the pleats along the top edge of a wall-hung drapery panel and simultaneously marking a fold point on the rear surface of the hem of the pleated drapery panel. The machine includes a workbench with a pivoted tabletop supporting a pair of adjustable mechanisms. The first adjustable mechanism comprises a series of equally spaced bars supported transversely on elongated slide rods. Each pair of bars is connected together by a threaded sleeve. A manually adjustable drive shaft extends through all of the sleeves for changing the spacing between each connected pair of bars in a uniform manner. The second adjustable mechanism may comprise a lazy tong mechanism that is pivotally connected to the first and last bars and every other bar therebetween so as to vary the distance between every other bar in a uniform manner. A third bar is equidistantly spaced between adjacent bars of the first and second adjustable mechanisms and extends forwardly of said adjacent bars. Each bar supports a marking pen. The adjacent bars of said first and second mechanisms mark a point indicating the boundary of the material required for the pleat and the material required for the space between the pleat. The third forwardly projecting bar marks a point on the drapery panel on the lower end thereof equidistantly spaced between the boundary marks for the spaces so as to indicate the fold line on the rear surface of the hem of the pleated panel.

9 Claims, 8 Drawing Figures

DRAPERY PLEAT AND FOLD LINE MARKING MACHINE

BACKGROUND OF THE INVENTION

1. Field of the Invention

This invention relates to mechanized equipment for assisting in making pleated window draperies by mass production, and particularly to a machine for marking the material required by the pleats and for marking the material required for the spaces between the pleats along the top edge of a drapery panel and for simultaneously marking the hem of the pleated panel to assist in folding the drape.

2. Description of the Prior Art

The most common manner of making draperies employs the hand-measuring of the various panels of drapery material. In recent years, precision machines have been devised to speed up the various operation, both to save labor and reduce the need for skilled labor.

The Caracoes U.S. Pat. No. 3,145,480 discloses a machine for marking the material required to form pleats along the top edge of a drapery panel. Caracoes accomplishes this by a series of pointers mounted on a single lazy tong apparatus. This machine marks (by pointers) the space required for both the pleat and the space between the pleat.

The Tuskos U.S. Pat. No. 3,696,515 shows a drapery pleats marking machine with a workbench that supports two vertically-disposed, lazy tong mechanisms. A marking pen is assembled at each intermediate pivot point of both lazy tong mechanisms. The adjustment of the first lazy tong mechanism changes the spacing P allotted for making material into the pleats, while the adjustment of the second lazy tong mechanism changes the spacing S. for the material required for forming the space between the pleats.

SUMMARY OF THE PRESENT INVENTION

The present invention provides a drapery pleat and fold marking machine having two adjustable mechanisms. The first adjustable mechanism is for marking the boundaries required for a series of spaces S on the drapery material between the pleats. The second mechanism is for marking the boundaries of the material required for forming the pleats P on the drapery material. The first mechanism comprises a series of equally spaced pairs of bars that are transversely supported on elongated slide means. Each pair of bars is joined together by an adjustable connecting means. This adjustable connecting means may be a threaded sleeve. There is an elongated drive means extending between the adjustable connecting means for adjusting the space between each pair of bars in a uniform manner. Each of the bars contains a marking pen for marking the drapery material.

The second adjustable mechanism comprises an adjustable interconnecting means that is connected to every other bar of the said series of pairs of bars so as to vary the distance between the pairs of bars in an equally spaced, uniform manner. One modification shows the second mechanism as a lazy tong mechanism, while a second modification shows the second mechanism as a motor driven threaded shaft. Again each of the bars supports a marking pen.

A third series of bars are equidistantly spaced between adjacent bars of said first and second adjustable mechanisms. These bars project forwardly and support marking pens. The bars are adapted to mark the drapery panel on the rear surface of the hem in the exact middle F of the space S designating the space separating the finished pleats of the finished panel. This mark F designates a fold line for the finished drapery panel.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
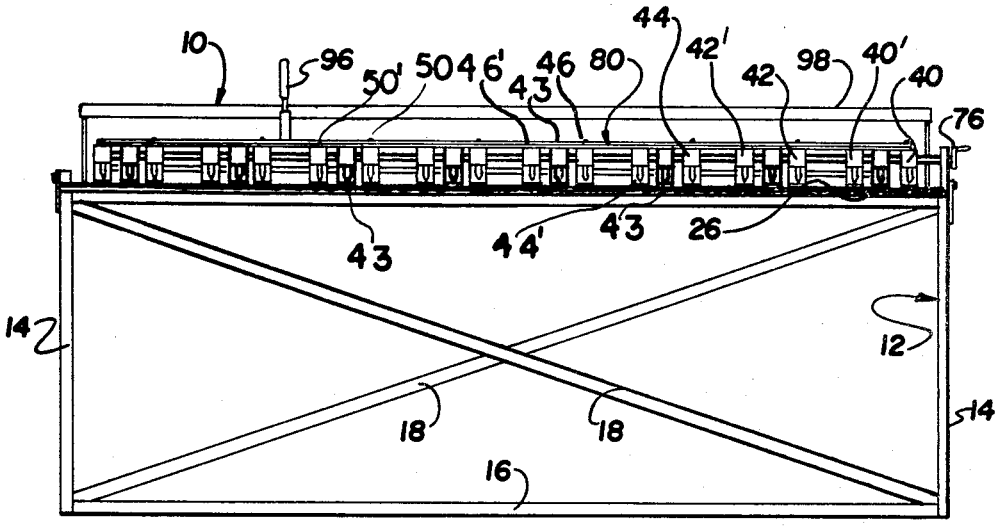
FIG. 1 is a front elevational view of a presently preferred drapery pleat and fold line marking machine made according to the present invention.

Turning now to a description of the drawings, and in particular to the front elevational view of FIG. 1, there is shown a drapery pleat and fold marking machine 10 according to the present invention. This machine 10 has a workbench 12 formed with vertical side standards 14 of about waist height that are braced by a horizontal base member 16 and several cross struts 18 which extend between the standards. Angle irons or light weight channel members function well in fabricating the workbench. The horizontal bench surface 20 is quite long to accomodate the widest width of a drapery panel that is to be marked by the machine with a series of spaces S between pleats and a series of spaces P that are allotted for making the material into pleats to create the fullness of the drapery panel and to mark a point for designation of a fold line along the bottom edge of the panel.

Figure 2:
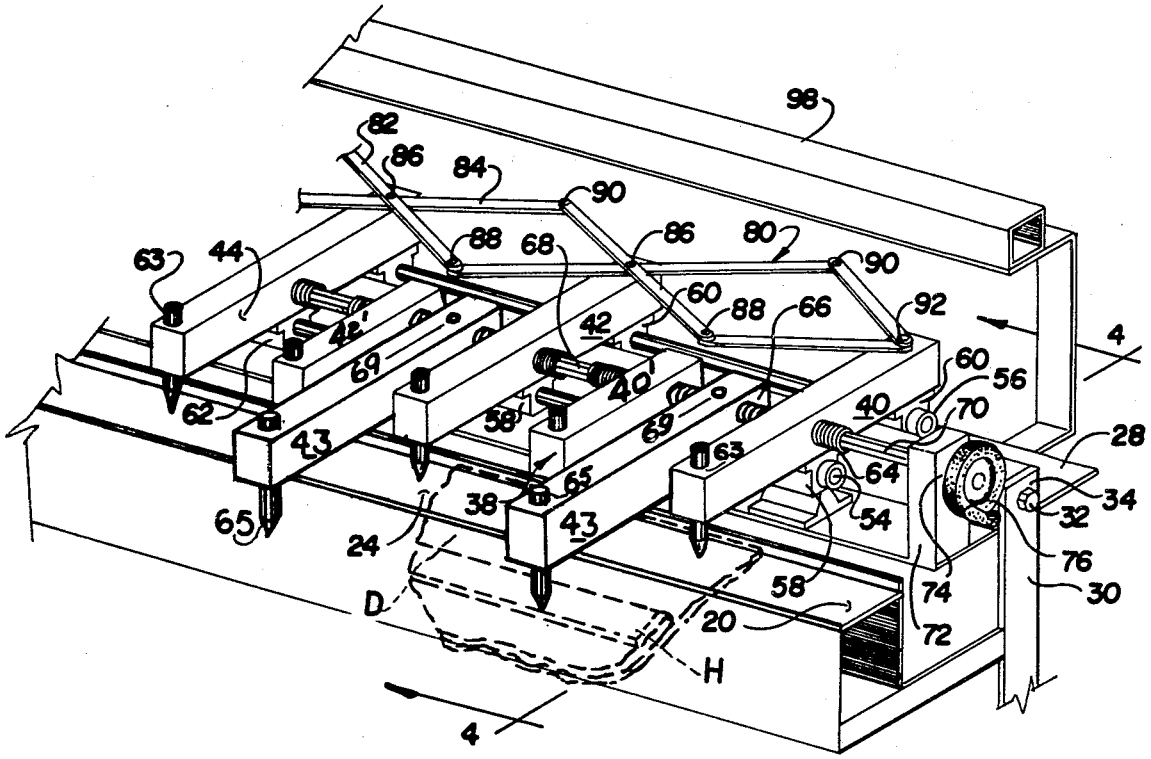
FIG. 2 is an enlarged fragmentary perspective view of the right end of the pivoted tabletop of the drapery pleat and fold line marking machine of the present invention.
Figure 3:
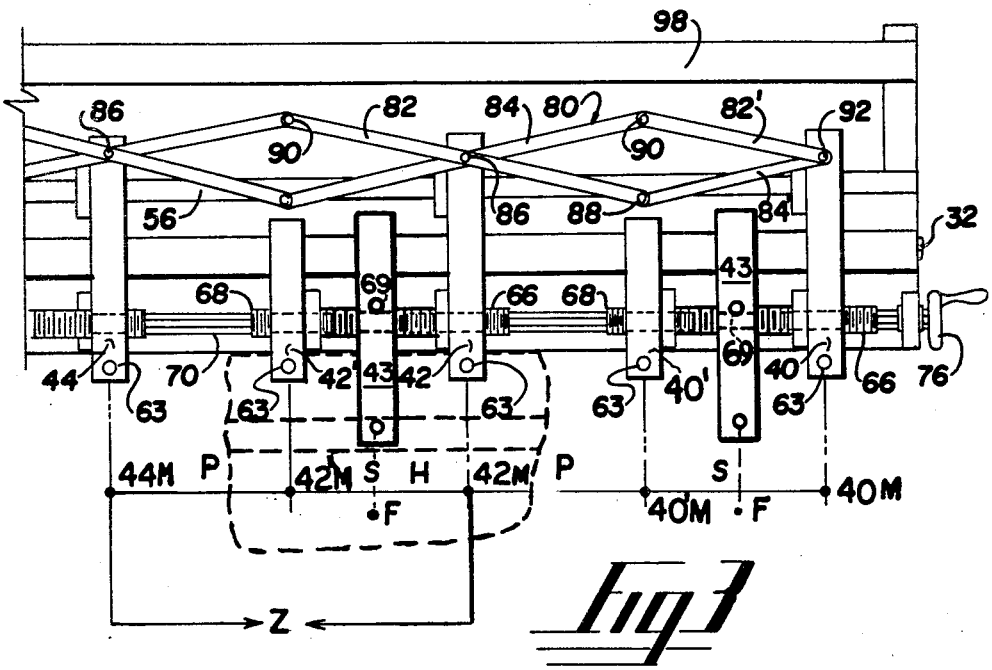
FIG. 3 is a fragmentary top plan view, of the machine, showing each pair of bars joined together by a threaded sleeve, slidably mounted on elongated drive shaft.

As is best seen in FIG. 2, the bench surface 20 includes a fixed front plate 24 on which the top edge of a drapery panel is to be positioned. A hydraulic or pneumatic presser foot assembly 26 is supported from the bench surface 20 for clamping the right hand corner of the drapery material (not shown) to the front panel 24. The bench surface 20 supports a pivoted tabletop 28 by means of a pair of vertical posts 30 at the two sides of the bench surface. A pivot pin 32 extends through the post and into a pivot hole 34. The table top 28 is able to rock about the pivotal axis of the pivot pin between the horizontal working position of FIG. 4, and the raised at-rest position of FIG. 5.

As is best seen in FIG. 2, the tabletop 28 supports a first adjustable mechanism 38 which comprises a series of pairs of equally spaced bars 40-40', 42-42', etc. These bars are supported transversely on a pair of parallel elongated slide rods 54 and 56. Beneath the even numbered bars, 40, 42, 44 etc., are a pair of bearing blocks 58 and 60. The bearing block 58 slips onto the rod 54, while the other bearing block 60 slip onto the rod 56. The shorter alternate bars 40', 42', etc. are shown with only a single bearing block 62 which slips onto the frontmost rod 54 only. Of course, the shorter bars 40', 42', etc., could be enlarged in size and provided with two bearing blocks as are the even numbered bars 40, 42, 44, etc. A marking pen 63 is vertically disposed in the front portion of each bar 40, 40', 42, 42', etc. These pens utilize a marking fluid which is invisible to the naked eye. The marks made by the pens 63 can only be seen when the drapery material is placed under an ultraviolet lamp.

A third bar 43, suitably supported on bearing blocks (not shown) is equidistantly mounted between the pair of bars of each system i.e., 40-40', 42-42', 44-44', etc. This bar 43, extends forwardly of the bars of the first and second adjustable mechanism. As will be hereinafter described, this bar contains a fold marking pin 65, which marks the exact middle of space S on the rear surface of the hem. Since the mark is placed on the rear surface of the hem, an ink visible to the naked eye can be utilized. I prefer however, to utilize a marking ink visible only under ultra-violet light.

The bars of each pair of bars 40-40', 42-42', etc. are joined together by a threaded sleeve 64. The exterior surface of each sleeve is provided with a left hand thread 66 at one end and a right hand thread 68 at the other end. The sleeve 64 extends into threaded holes in the side of each pair of bars. The relative positions of the pairs of bars 40-40', 42-42', 44-44' may be set by manually turning the sleeve 64 which causes the bars to slide on their supporting rods. By having the two sets of thread left 66 and right 68 hand threads, the movement of the bars is toward one another, when the drive shaft 70 is turned in one direction. When the direction of shaft 70 is reversed, the bars' movement is reversed i.e., away from each other. Bar 43 is slidably fitted over the sleeve 64 over the unthreaded portion 67. An anchoring pin 69 is driven through the top face of bar 43 and fits into groove 71. This allows the sleeve to rotate without moving bar 43. As a result bar 43 is always equidistantly placed relative to bars 40-40', 42-42' and 44-44', etc.

The spacing S between pleats conforms to certain standard conventions. Thus, with a drapery width of 42–48 inches, the spacing between pleats will be 4 inches. The standard spacing for standard width materials has been charted so that all that is necessary to do is to look at the chart and at the particular width of material being measured for pleats. Thus, once the operator has determined the approximate width of the material to be pleated, the proper spacing for that width can be readily ascertained by reference to the published charts. The variable is the width of the pleat. Once the pairs of bars, 40-40', 42-42', etc., have been set for the proper space for the width being considered, this portion of the operation has been completed. It should be pointed out that a width of material is the width as it comes from the mill. One or more widths of material hemmed together with matching patterns etc., form a drapery panel. Therefore, a panel may consist of one or more widths.

Once the connected pairs of bars are properly spaced apart by the same amount, they must be driven by a common prime mover so that they may be adjusted uniformly to accomodate different dimensions of drapery panels. This need is furnished by a noncircular, or hexagonal, drive shaft 70 which extends for the length of the machine through each of the threaded sleeves 64. The sleeves 64 are tubular in nature so as to slide on shaft 70. They are each provided with a fixed plug (not shown) that is driven into one end of the sleeve and has a hexagonal hole (not shown) for receiving the drive shaft therethrough in driving engagement (when the shaft is rotated). A vertical end post 72 is supported on the edge of the tabletop 28 in alignment with the drive shaft 70. This post is provided with a bearing 74 for receiving the drive shaft therethrough. A handwheel 76 is fixed on the free end of the drive shaft 70 to provide a convenient means for adjusting the spacing between the connected pair of bars 40-40', 42-42', 44-44', etc.

A second adjustable mechanism 80 comprises a lazy tong mechanism having a plurality of intersecting links 82 and 84 that are pivoted together at an intermediate point 86, as well as at their ends at 88 and 90. The opposite ends of the lazy tong mechanism terminate into half-lengths 82' and 84', and they are joined by a pivot pin 92. This pivot pin 92 is also pivoted to the end bar 40, while the intermediate pivots 86 are also pivoted to every other bar 42, 44, 46, etc. The shorter bars 40', 42' etc. are all out of contact with the lazy tong mechanism 80.

Figure 4:
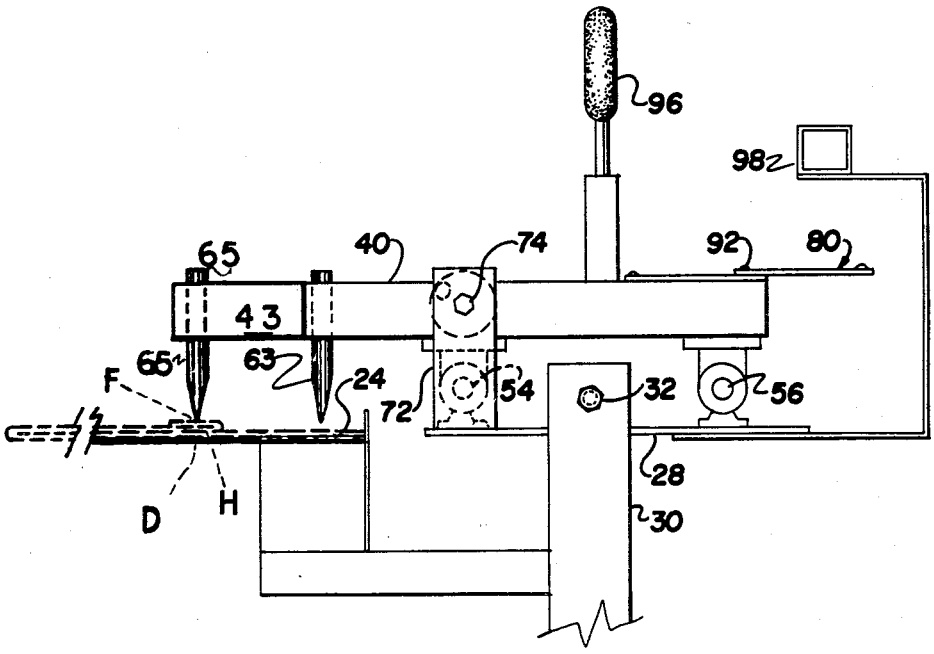
FIG. 4 is a fragmentary right elevational view taken on the line 4—4 of FIG. 2 showing the tabletop in its horizontal working position with a marking pen engaging the drapery material. A vertical handle is shown for operating the horizontal lazy tong mechanism in a back and forth direction. Moreover, a second elongated handle at the back of the machine is shown for rocking the tabletop back on its pivot means so as to lift the marking pens from the drapery material.

As best seen in FIG. 4, the lazy tong mechanism 80 is horizontally disposed across the rear ends of the bars of the first adjustable mechanism. A vertical handle 96 is positioned on the lazy tong mechanism near the left end of the machine for adjusting the length of the lazy tong mechanism 80 to conform to the width of the drapery panel.

The space between alternate bars 40-42, 42-44, is designated as Z. It will be noted therefore, that Z equals P+S. As has previously been indicated, the space S is standard for particular widths of drapery material, P is the variable. Therefore, once the spacing S had been properly set on pairs of bars 40-40', 42-42' 44-44', etc., all that is necessary to do then is to adjust the length of the lazy tong mechanism so as to move alternate bars the exact width of the panel measured. The pins, therefore, are in the proper position for making the marks as is shown in projected lines on FIG. 3. Thus, as is illustrated, bar 40 marks the top of the drapery 40 M through pin 63 while bar 40' is designated as 40'M. The space between 40 M and 40'M is designated as S. The space between 40 M and 42 M can be designated as Z. Additionally, the space between 40 M and 42 M is then designated as P, i.e., the amount of space required for making the pleat. Now, as is shown in FIGS. 3, 4, 5 and 6, the hem H of the drapery panel D can be pulled into position so that the rear surface of the hem can be marked by pin 65 mounted in forwardly projecting bar 43. This mark is designated as F and is located as is shown in the projected lines shown on FIG. 3 exactly in the middle of space S. It should be understood that the mark F as illustrated is applied to the drapery fabric after the hem has been sewn in.

The same procedure can be utilized to mark the drapery panel prior to finishing the hem. The mark can be applied identically as illustrated except that the hem would not yet have been completed. In other words, once the fabric at the bottom of the panel has been folded, the hem can be marked. Thereafter, the fabric can be blind stitched or adhesively secured by known methods, after the marking operation.

Figures 7, 8:
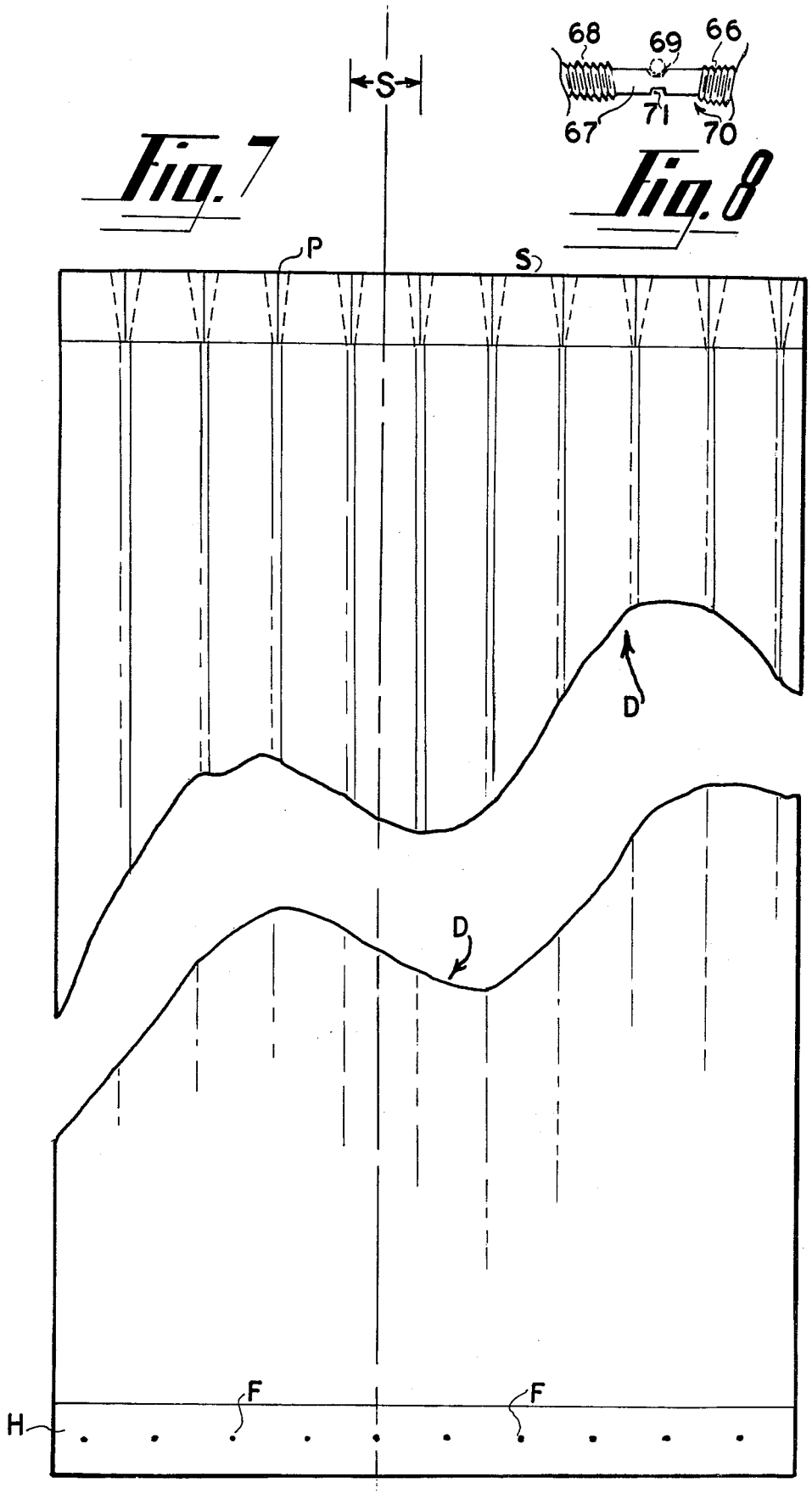
FIG. 7 is an elevational view (viewed from the rear) of a portion of a pleated drapery panel, with the pleats shown in phantom lines and illustrating the space S located between the finished pleats.
FIG. 8 is a fragmentary view of the threaded sleeve containing a centrally located unthreaded portion and a groove for accommodation of an anchoring pin.

Once the drapery panel has been marked, the pleats can be placed into the top edge of the panel by standard procedures. While it is not absolutely necessary, a preferred method of utilizing the marking device of this invention involves the sewing of the hem H at the bottom edge of the panel prior to marking. Thus, as can be seen, by reference now to FIG. 7, the drapery panel is marked with ultra-violet sensitive ink at point F on the rear surface edge of the hem to designate a fold line for folding up the draperies prior to shipping. Additionally, it is possible to insert a memory thread into the hem of the drapery to maintain the proper drapery fold. The process of sewing memory thread between adjacent fold lines F is old. However, in the past it has been necessary to suspend the drapery from a rod either in the home or in the shop after the pleating has been completed and sew in the thread from the middle of the space defining the pleats at the bottom. As is shown in the drawing, the creases formed by the pleats tend to fall away from the fold line in the lower section of the panel. Thus, accurate placement of the memory thread involves a great deal of experience and in some cases, involves a great deal of guess work. Additionally, as will be appreciated, the location of the hem being close to the floor places the workroom personnel in awkward positions which must be maintained for some periods of time to accurately install the memory thread. As will be shown in FIG. 7, the length of the memory thread is equal to S. Therefore, by the technique which is available, according to the improved mechanism described and shown herein, the drapery panel can be placed on a table at a comfortable position and the workroom personnel can quickly and accurately sew in the memory thread from mark F to mark F of adjacent spaces S between the pleats. Additionally, in folding the finished drapery for shipment to the consumer the party at the hem end of the drapery can easily determine the proper fold line so that a proper fold is made in the drapery at time of packaging.

As will be appreciated, in humid climates, and particularly with loosely woven fabrics, once an improper fold line has been established it is almost impossible to change it.

Thus, it can be seen that the turning of the drive shaft 70 adjusts the spacing S between the pairs of connected bars 40-40', 42-42', 44-44', while the shifting of the handle 96 to adjust the length of the lazy tong mechanism 80 adjusts the spacing between the alternate bars 40, 42, 44, 46, etc. and thus establishes the spacing P. This is so because the spacing between the alternate bars 40, 42, 44, 46 etc. is made up of the spacing S plus the spacing P. Since the spacing S is adjusted by the setting of the drive shaft 70, the lazy tong mechanism uniformly establishes the spacings P.

Figure 5:
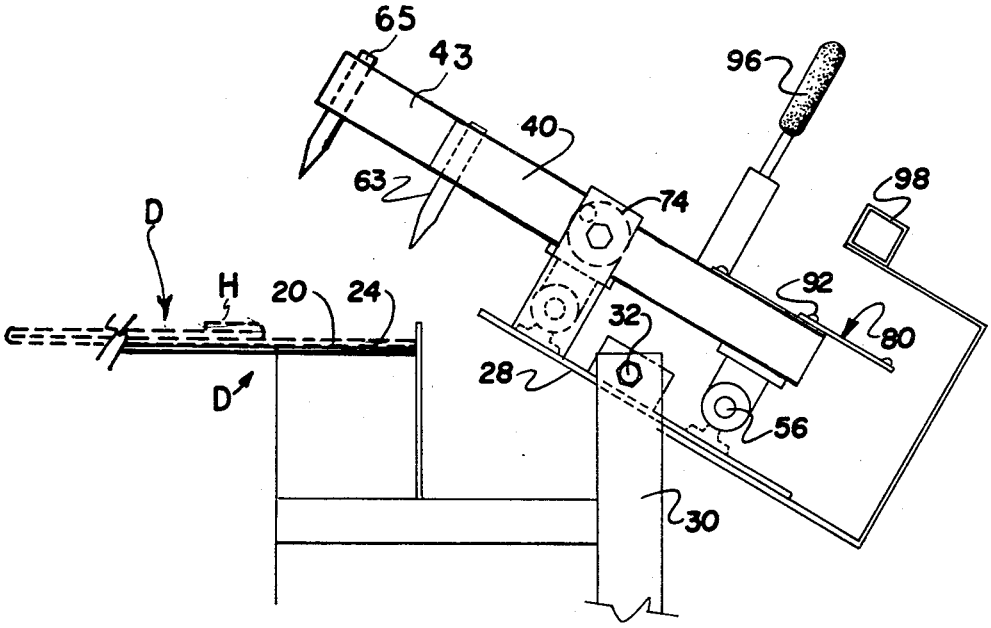
FIG. 5 is a fragmentary view similar to that of FIG. 4 showing the tabletop rocked back on its pivot into an at-rest position for installing and removing the drapery material.

As is best shown in FIGS. 4 and 5, the rear edge of the pivoted tabletop 28 is provided with an elevated horizontal handle 98. The tabletop 28, with its first and second adjustable mechanisms 38 and 80 respectively, is balanced so as to stay when placed in its raised "at rest" position of FIG. 5 by pushing back on the horizontal handle 98 to pivot the tabletop on its pivot pins 32.

Figure 6:
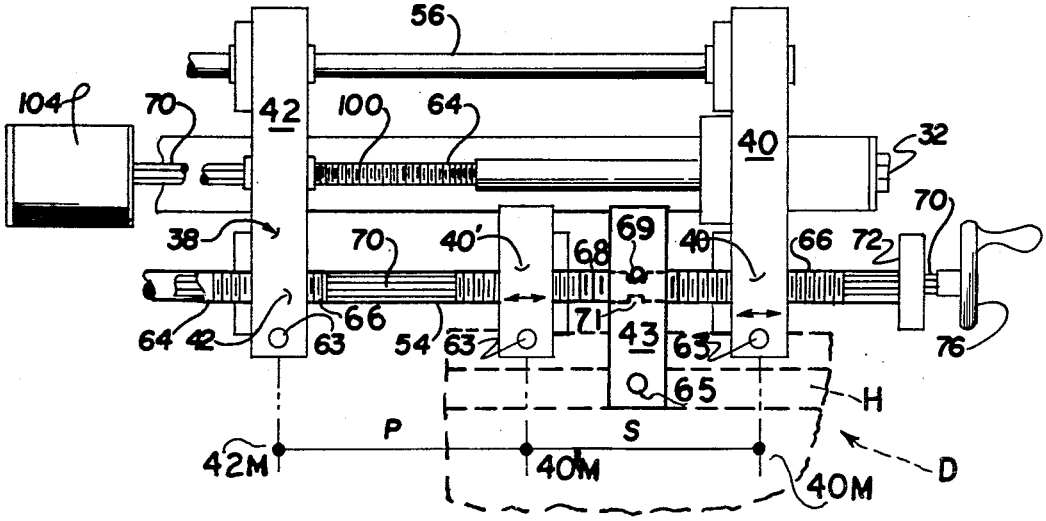
FIG. 6 is a fragmentary plan view of another modification, wherein the lazy tong mechanism is replaced by a motor driven threaded shaft for changing the spacing between every other bar, and hence to set the uniform spacings P between the uniform spacings S.

Turning now to a consideration of the second modification of FIG. 6, it should be understood that parts that are common in both modifications will retain the original reference numerals. The first adjustable mechanism 38 has not changed. This first mechanism includes the bars 40, 40', 42, 42', 44, 44', etc. There is a series of evenly spaced pairs of bars 40-40', 42-42', 44-44', etc. that are each joined together by the threaded sleeve 64. Additionally bar 43 is mounted between each pair of bars. A single drive shaft 70 slidably extends through all of the threaded sleeves 64, so as to be in operative engagement only upon rotation.

A motor driven threaded shaft 100 replaces lazy tong mechanism 80. The first bar 40 is fixed, so the shaft 100 does not alter its position. The threaded shaft 100 extends through a threaded bearing 102 in every other bar 42, 44, 46 etc. so that the rotation of the shaft causes the bars to move along the length of the shaft. A reversible motor 104 is arranged at the left end of the threaded shaft. The threaded shaft 100 could be fabricated out of a hexagonal drive shaft, such as 70, plus sections of slidably mounted sleeves comparable to sleeves 64.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A drapery pleat marking and fold marking machine comprising:

A. a supporting base member;

B. a first adjustable mechanism for marking a first series of spaces on a drapery panel;

C. a second adjustable mechanism for marking a second series of spaces between the first series of spaces;

D. said first adjustable mechanism comprising a series of equally spaced pairs of bars, slidably mounted on elongated slide means; each pair of bars being joined by an adjustable connecting means, and an elongated drive means in operative relation with said adjustable connecting means of each pair of bars; said drive means co-acting with said adjustable connecting means to adjust the space between each of the bars of each pair of bars in a uniform manner; said adjustable connecting means being longitudinally slidable on the elongated drive means;

E. a third series of bars, equidistantly mounted in fixed relation between each pair of equally spaced bars for making a third series of marks on the drapery panel;

F. said second adjustable mechanism comprising adjustable interconnecting means serving to vary the distance between each pair of bars in a uniform, equally spaced manner; and G. marking means provided on each bar and adapted to engage the drapery panel for marking off the several series of spaces.

2. The invention as recited in claim 1 wherein the said first adjustable mechanism has an adjustable connecting means between each pair of bars in the form of a threaded sleeve slidably mounted on said drive means, said elongated drive means extending between the adjustable connecting means being a rotatable drive shaft extending through the threaded sleeves and adapted to turn the sleeves with respect to the series of pairs of bars.

3. The invention as defined in claim 2, in which the threaded sleeve is threaded with a right hand thread on one end and a left hand thread on the other end, whereby rotation of the sleeve moves the bars driven thereby toward each other or away from each other, depending upon the direction of rotation of the sleeve.

4. The invention as recited in claim 2, wherein the said threaded sleeves contain a centrally located section which is unthreaded.

5. The invention as defined in claim 4, in which the centrally located unthreaded portion of the threaded sleeve contains a groove, in combination with an anchoring pin, engageable in said groove for anchoring the middle bar in an equidistant position between bars while allowing the sleeve to rotate.

6. The invention as recited in claim 2 wherein the said supporting base member includes a workbench having a pivoted tabletop that carries the first and second adjustable mechanisms, said tabletop having a first raised position where the marking means are raised out of position and a second lowered position where the marking means are adapted to engage the drapery material on the workbench.

7. The invention as recited in claim 1 wherein the said first series of spaces represent the spaces S on the drapery material between the pleats, and the said second series of spaces represent the spaces P on the drapery material that are allotted for forming the pleats, and the third series of marks indicates the fold line in the exact middle of the space S.

8. The invention as recited in claim 1 wherein said second adjustable mechanism comprises a lazy tong mechanism having intersecting links pivotally connected to the first and last bars of said machine, and pivotally connected to one member of each pair of bars, said member being located to the right of the pair of bars when viewing the machine from the front, and handle means for changing the length of the lazy tong mechanism.

9. The invention as recited in claim 1 wherein the said adjustable interconnecting means of the second adjustable mechanism comprises a motor driven threaded shaft means cooperating with one member for each pair of bars, said member being located to the right of the pair of bars when viewing the machine from the front.

* * * * *